United States Patent [19]

McKay

[11] Patent Number: 5,024,202

[45] Date of Patent: Jun. 18, 1991

[54] METERING OF FUEL

[75] Inventor: Michael L. McKay, Willeton, Australia

[73] Assignee: Orbital Engine Company Proprietary Limited, Balcatta, Australia

[21] Appl. No.: 349,556

[22] Filed: May 5, 1989

Related U.S. Application Data

[62] Division of Ser. No. 849,501, Mar. 24, 1986, Pat. No. 4,841,942.

[30] Foreign Application Priority Data

Aug. 1, 1984 [AU] Australia ..... PG6327/84

[51] Int. Cl.[5] ..... F02M 23/00

[52] U.S. Cl. ..... 123/533; 123/531; 239/533.2

[58] Field of Search ..... 123/531, 533, 586, 587, 123/585, 532; 239/88-96, 407-411, 113, 533.2

[56] References Cited

U.S. PATENT DOCUMENTS

| | | | |
|---|---|---|---|
| 3,285,233 | 11/1966 | Jackson | 123/531 |
| 4,368,714 | 1/1983 | Emmenthal | 123/531 |
| 4,381,077 | 4/1983 | Tsumura | 123/531 |
| 4,387,696 | 6/1983 | Yogo | 123/531 |
| 4,465,050 | 8/1984 | Igashira | 123/531 |
| 4,693,224 | 9/1987 | McKay | 123/531 |
| 4,754,735 | 7/1988 | Simons | 123/531 |
| 4,794,902 | 1/1989 | McKay | 123/531 |
| 4,823,756 | 4/1989 | Ziejewski | 123/531 |
| 4,841,942 | 6/1989 | McKay | 123/533 |

FOREIGN PATENT DOCUMENTS

| | | | |
|---|---|---|---|
| 344078 | 11/1921 | Fed. Rep. of Germany | 123/531 |

*Primary Examiner*—Carl Stuart Miller

*Attorney, Agent, or Firm*—Armstrong, Nikaido, Marmelstein, Kubovcik & Murray

[57] ABSTRACT

A method and apparatus for metering fuel to an engine wherein a continuous supply of fuel is provided by a pump (14) to a fixed capacity chamber (11) and gas under pressure is admitted periodically to said chamber to maintain in the chamber a pressure not greater than the fuel pressure, so that fuel will flow into the chamber as long as there is a pressure differential between the gas in the chamber and the fuel supply. A delivery port (20) in said chamber is open for substantially the duration of the period that gas is admitted to the chamber so that the fuel in the chamber at the time of admission of gas thereto, and fuel entering the chamber during the period of admission of gas, is delivered from the delivery port (20) to the engine. The pressure differential between the fuel supply and the gas in the chamber is controlled in accordance with the fuel demand of the engine to control the quantity of fuel delivered each cycle to the engine. A preferred form of each of a fuel referecing regulator (34), a fuel pressure regulator (16) and a metering and injection unit (25) are also disclosed.

18 Claims, 4 Drawing Sheets

METERING OF FUEL

This is a division of application Ser. No. 849,501 filed Mar. 24, 1986, now U.S. Pat. 4,841,942.

This invention relates to the metering of fuel to an engine particularly in applications where the fuel is injected directly into the combustion area of an engine.

There has previously been proposed methods of metering fuel wherein the metered quantity of fuel is displaced from a variable capacity chamber by a charge of gas, such as air, at an appropriate pressure. It is considered that the charge of gas contributes significantly to the efficient combustion of the fuel, at least in part because of improved atomization of the fuel.

It is the object of the present invention to provide a method and apparatus for delivering a metered quantity of fuel by a charge of gas which is effective and accurate in operation, convenient to manufacture and maintain, and assists in promoting a high degree of atomization of the fuel.

With these objects in view there is provided a method of metering fuel to an engine comprising supplying fuel and gas at respective pressures simultaneously to a chamber, cyclically communicating said chamber with the engine to deliver the fuel from the chamber to the engine by a flow of gas from the chamber, and regulating the pressure difference between the fuel and gas supplies to the chamber in accordance to engine load to control the quantity of fuel delivered to the engine per cycle.

More specifically there is provided a method of metering fuel to an engine comprising providing continuously a supply of fuel under pressure to a closed fixed capacity chamber, periodically admitting gas to said chamber to maintain in the chamber a pressure not greater than the fuel pressure and opening a delivery port in said chamber for substantially the duration of the period of admission of gas to the chamber, whereby fuel in the chamber upon the admission of gas and fuel entering the chamber during the period of admission of gas is delivered from the delivery port.

Preferably the gas establishes a pressure in the chamber that is less than the fuel pressure so that fuel will continue to flow into the chamber while the gas pressure exists therein. Conveniently regulation of the quantity of fuel delivered is effected by varying the pressure difference between the chamber gas pressure and the fuel supply pressure and/or the duration of the period of admission of gas to the chamber.

As the difference between the fuel pressure and the gas pressure in the chamber during the fuel delivery period increases, the greater will be the amount of fuel which will flow into the chamber, and hence be discharged from the delivery port, for any selected period of admission of the gas to the chamber. Also while the admission of gas to the chamber is terminated, and the delivery port closed, fuel will continue to flow into the chamber until the pressure in the closed chamber equals the fuel supply pressure. Thus, between each period of admission of gas to the chamber a quantity of fuel will accumulate in the chamber. This quantity will increase as the difference between the fuel pressure and the gas pressure in the chamber at termination of the gas admission increases.

It will therefore be appreciated that by varying the above referred to pressure difference the quantity of fuel delivered during each period of opening of the delivery port maY be regulated. The varying of the pressure difference may be achieved by varying the pressure of the fuel supply and/or the pressure of the gas supply. As normally the fuel is liquid, it is thus more convenient to regulate the fuel pressure and to maintain the gas pressure substantially constant.

The quantity of fuel delivered may of course also be varied by variation of the duration of admission of gas to the chamber while the delivery port is open, as fuel continues to flow into the chamber during this period.

Thus by varying the pressure difference above referred to, and/or the gas admission period in accordance with the fuel demand of the engine there is achieved a fuel metering system for a combustion engine. Preferably sudden variations of fuel demand may be accommodated by varying the length of the gas admission period, while more gradual variations are accommodated by varying the pressure difference between the fuel and gas.

During the period that the delivery port is open and air and fuel are both entering the chamber, the quantity of fuel delivered will be $$\Delta h_1 = [2d(P_f - P_m)]^{\frac{1}{2}} A_3 \Delta t$$

where $\Delta m_1$ —mass of fuel d—density of fuel

Pf—fuel supply pressure

Pm—gas pressure in chamber at the end of delivery before valve closes $A_3$—area of fuel entry port $\Delta t$—effective period of port opening During the period that the chamber is closed to the admission of gas and the delivery of fuel continues, the quantity of fuel that will accumulate in the chamber is $$\Delta m_2 = dV\left(\left[\frac{P_f - P_m}{P_f}\right)\right]^{1/n}$$

$V$ - chamber volume $n$ - exponent of compression

In any single fuel delivery cycle the total quantity of fuel supplied will be $$\Delta m = \Delta m_1 + \Delta m_2$$

It is to be noted that for a given metering geometry and fuel density $\Delta m_2$ is dependent principally on the pressure difference between the fuel and gas and is independent of any particular metering period, while $\Delta m_1$ is dependent on both pressure difference and time.

The pressure $P_m$, that is, the pressure in the chamber when the delivery port and the port through which the gas enters the chamber are both open, is influenced by the areas of the respective ports. As the ratio of the area of the delivery port to the area of the gas entry port decreases, the closer $P_m$ will be to the gas supply pressure.

In order to obtain optimum accuracy in the metering of the fuel the port admitting the gas the and delivery port should open and close simultaneously, although slight misphasing is acceptable.

Conveniently the fuel supply pressure may be controlled by a regulator that is responsive to the fuel demand of the engine. The regulator may be electrically actuated under the control of a current determined electronically from sensings of a number of engine load condition parameters.

There is also provided by the present invention apparatus for metering fuel to an engine comprising a chamber having an open fuel port, a selectively operable gas port and a selectively operable delivery port, means to regulate the pressure differential between the fuel and gas supplies to the fuel and gas ports in response to the engine load, and means to selectively open said gas and delivery ports to deliver from the chamber when both said fuel and gas ports are open, the fuel in and fuel entering the chamber while the discharge port is open.

More specifically there is provided apparatus for metering fuel to an engine comprising a fixed capacity closed chamber having a fuel delivery port and a gas admission port, valve means operable to selectively open and close said ports substantially simultaneously, fuel supply means adapted to provide continuously a supply of fuel to said chamber at a fuel supply pressure, gas supply means adapted to provide gas for admission to the chamber when both said ports are open so the gas pressure in the chamber is not greater than the fuel supply pressure. and means to vary the pressure difference between the gas in the chamber when said ports are open and the fuel supply and/or the duration of the period of admission of the gas to the chamber to thereby regulate the quantity of fuel delivered while the delivery port is open.

Conveniently the valve means include respective valve elements to co-operate with each port, the valve elements being coupled together and operated by a single actuator means.

Preferably the effective area of each of the ports is selected so that a predetermined pressure drop is obtained between the gas supply pressure and the gas pressure in the chamber when both ports are open and fuel is being delivered.

Conveniently electronic controls are provided to regulate the period of opening of the ports and/or the pressure difference between the gas and fuel to thereby control the quantity of fuel delivered each time the ports are opened. The electronic controls are responsive to the fuel demand of the engine which is detected by various sensor of engine conditions such as manifold pressure and/or temperature and/or mass flow; and ambient temperature and rate of change of any or all of these conditions.

The invention will be more readily understood from the following description of one practical arrangement of the method and apparatus for metering fuel which is illustrated diagrammatically in the accompanying drawings.

Figure 1:
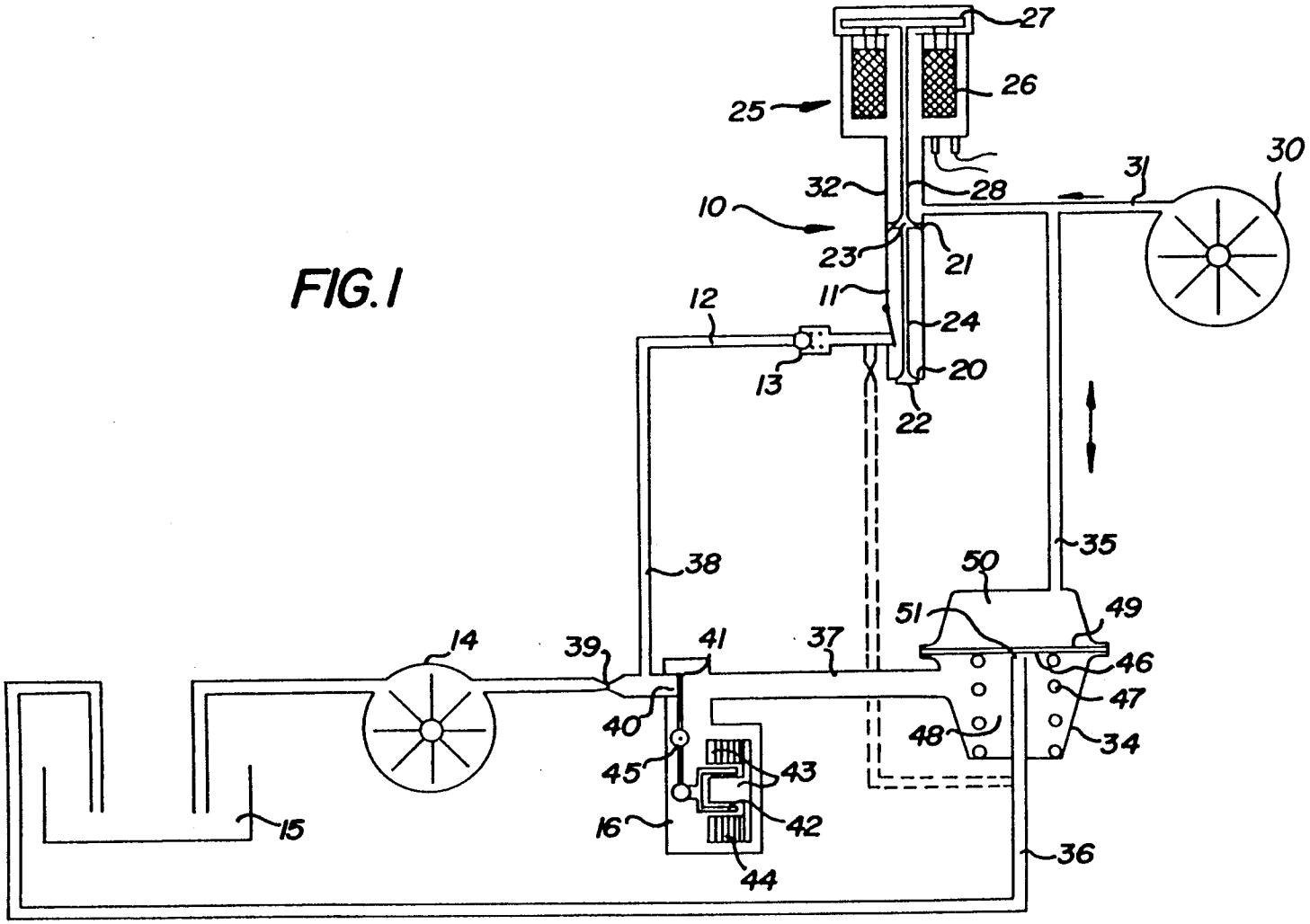
FIG. 1 is a schematic diagram of the fuel supply system embodying the present invention.

The metering apparatus 10 comprises a chamber 11 of a fixed volume and closed to the surrounding atmosphere except for the various ports as hereinafter described. Communicating with the chamber 11 intermediate its length is a fuel supply conduit 12 that receives fuel from the fuel pump 14 which draws fuel from the fuel reservoir 15. The pressure of the fuel in the conduit 12 on the delivery side of the pump 14 is controlled by the fuel pressure regulator 16 which will be described in further detail hereinafter.

The metering chamber Il has at one end a delivery port 20 and at the opposite end an air admission port 21. Operatively associated with ports 20 and 21 are respective valve elements 22 and 23 rigidly connected by the actuator rod 24 so that the valve elements move with respect to their co-operating ports simultaneously.

The solenoid type valve actuator 25 has an electromagnet coil 26, and an armature 27 which is coupled to the rod 24 by an axially aligned member 28. The armature 27 is spring loaded in the upward direction, as seen in the drawing, so as to normally hold the valve elements 22 and 23 in the ports 20 and 21 so that the latter are closed. Energizing of the coil 26 by an electric current causes the armature 27 to move downwardly, as viewed in the drawing, and hence displace the valve elements 22 and 23 and open the ports 20 and 21.

The air compressor 30 is connected by the conduit 31 to the cavity 32 externally of the metering chamber 11 and immediately adjacent the port 21. The conduit 31 and hence the air on the delivery side of the pump 30 is in communication with the referencing regulator 34.

The compressor 30 may have its own air pressure regulator to control the basic supply pressure relative to atmospheric conditions, but this is not essential to the function of the metering system of the present invention, and is therefore not further discussed here. Additionally the air compressor could be replaced by an alternative gas or liquid source which may be of practical significance where dual fuelling via alternative fuels is contemplated or where a more convenient gas source is available. Where a liquid is used as a substitute to the gas some modification will be necessary to the metering system.

The referencing pressure regulator 34 acts iu a manner whereby the pressure difference between conduits 35 and 37 is maintained essentially constant. This characteristic allows the fuel pressure in conduit 37 to rise or fall to compensate for variations in the air supply pressure.

This characteristic may be explained as follows Fuel supplied by the pump 14 passes into both conduit 38 and conduit 37. In the latter case fuel passes through port 40 and past the member 41, incurring a pressure drop or not, depending on the programming of fuel pressure regulator 16. The operation of this device does nòt impact the present explanation and will be described further in due course.

Fuel passing through conduit 37 enters chamber 48 where the pressure of the fuel on diaphragm 49 sublimates the force applied thereto by spring 47 to oppose the force created by the air pressure in chamber 50 acting on the opposite side of the diaphragm 49. When the total force om the fuel side of the diaphragm increases above that the air side, the port 51 will open to permit fuel to flow from the chamber 48 through the return conduit 36 to the fuel reservoir 15. Any tendency for the pressure to rise in chamber 48 relative to that in chamber 50 results in further displacement of the diaphragm 49 to increase the flow path at the port 51, to prevent that increase in fuel pressure in the chamber 48.

It may be shown that the pressure each side of the diaphragm would become essentially equal if the spring 47 were not present. The spring loading allows an essentially fixed pressure difference to be maintained. In this case the fuel pressure is regulated to be lower than the air pressure, which determines a basic reference of the fuel pressure to the air supply to the pressure metering apparatus 10. This pressure relationship is reflected essentially, at conduits 12 and 31 if no pressure drop exists across the regulator 16.

The function of the programmed regulator 16 is to modify the relative fuel and air pressure at the metering apparatus 10 by forcing a pressure difference to exist between port 40 and conduit 37. This pressure difference is reflected as an increased fuel pressure upstream of port 40 relative to the air supply pressure, given that a fixed relationship exists between conduits 37 and 35. It may be shown that a sufficiently high pressure difference across the programmed regulator 16 will result in the fuel pressure in conduit 12 to be above the air pressure in conduit 31 and cavity 32.

The programmed regulator 16 may be configured to operate in a variety of ways. Conveniently the device is electronically programmable. In the example shown, fuel from the fuel pump 14 passes through the restriction 39, which acts only to conveniently limit flow, but is not essential to the operation of the regulator 16. The fuel passes through port 40 via the spill member 41. Depending on the magnitude of changed flow path area through port 40 a corresponding change in pressure difference between port 40 and conduit 37 is established.

The magnitude of this change may be effected to some degree by pressure-flow characteristics of the pump 14. Conveniently, pump characteristics may be made to have little effect on the programming supplied to the regulator 16, as in the particular configuration shown.

This arises from the fact that the change in the flow path area through port 40 may be accomplished by a force equilibrium in the member 41. This equilibrium is between the fluid pressure at port 40, acting over the projected area of the port, normal to the member and equilibrated by an electro- magnetic force created on the coil 42, again normal to the member 41 about a pivot 45. This pivot is not essential to the operation of the device insofar as direct application of the electro-magnetic force may be made to a valve element associated with the port 40.

Conveniently, the electro-magnetic force is created by a permanent magnet 44, through magnetic paths 43, interacting with a current in the coil 42. A force proportional to the current in the coil is thus created which, in turn, creates a proportional pressure drop between port 40 and conduit 37. Thus, an input of electrical current in coil 42 may programme a corresponding pressure drop in proportion to the current, and essentially independent of the characteristics of the pump 14.

It will be appreciated that there are alternative ways to programme the pressure differences between conduit 12 and cavity 32, communicated to by conduit 31.

One example would be to utilise less reliable programming of the pressure differences referred to above while achieving accurate relativity, by actually measuring the pressure difference between conduit 12 and cavity 32 and programming a rudimentary regulation system to achieve a predetermined pressure difference, rather than rely on the relationship between input current and output pressure of a control device. This alternative would have so-called "closed loop" characterisation, rather than so-called "open loop" characterisation of the required pressures at the metering apparatus 10 demonstrated by the earlier described system.

With the above discussed relationship between the pressure of the fuel entering the metering chamber 11 and the air supply available at the air admission port 21 the metering of the fuel is carried out in the following manner. Upon energizing the coil 26 of the solenoid 25 the armature 27 moves downwardly so that the valve elements 22 and 23 are opened simultaneously. At this point, air enters the metering chamber 11 causing the fuel already in the metering chamber 11 to be displaced through the fuel delivery port 20, whilst at the same time fuel continues to flow into the metering chamber from the fuel conduit 12 This fuel is immediately entrained in the air passing through the metering chamber 11 and is thus discharged through the fuel delivery port 20. There is therefore a continuing flow of fuel into the metering chamber and delivery thereof from the fuel delivery port 20 so long as the solenoid coil 26 remains energized.

Upon the de-energizing of the coil 26 the valve elements 22 and 23 are immediately returned by spring loading to their closed positions, seated in the ports 20 and 21 respectively, terminating the supply of air to the metering chamber 11 and terminating the delivery of fuel from the fuel delivery port 20. At this point in time there is a quantity of air confined within the metering chamber 11 at a pressure below the pressure of the fuel in the fuel conduit 12. Thus fuel will continue to flow into the metering chamber 11 until the volume of fuel in the metering chamber is such that it has compressed the air confined in the metering chamber to a pressure equal to the pressure of the fuel in the fuel conduit 12. Thus, with this balanced pressure condition between the fuel conduit 12 and the metering chamber 11 the flow of fuel into the metering chamber will cease.

When the solenoid 26 is next energized the valve elements 22 and 23 are again moved to the open position, air enters the metering chamber through the port 21, and the fuel in the metering chamber is delivered therefrom through the port 20. Also the pressure in the metering chamber will now fall to a pressure related to the air supply, normally lower. Fuel will again commence to flow into the metering chamber via the conduit !2, and thereafter be delivered through the fuel delivery port 20, as previously described, until the ports 20 and 21 are closed as a result of the de-energizing of the solenoid coil 26.

The operation of the solenoid 25 is controlled by a suitable mechanism which is responsive to the fuel demand of the engine, and will thus remain energized for a time interval that will permit the required amount of fuel to be delivered from the fuel delivery port 20 to meet the engine demand at that particular period. The regulation of the fuel supply may also be achieved by either varying the time for which the solenoid is energized, or by energizing the solenoid for a fixed period each time but varying the number of periods that the solenoid is energized for each cycle of the engine.

In addition to the control that may be obtained by the varying of the period or number of cycles of the solenoid, it is also possible as previously discussed to vary the fuel supply by controlling the pressure of the fuel relative to the pressure of the air. Also it is possible for both these controls to be operated so that the combined effect produces the required quantities of fuel to be delivered to the engine.

Suitable programmed processes may be set up to regulate the energizing of the solenoid 25 and the operation of the regulator 16 in accordance with the various known programmes of sensing a range of engine conditions and processing these to produce electric signals appropriate to op rate the solenoid or like device for regulation of the amount of fuel delivered to the engine.

Figure 2:
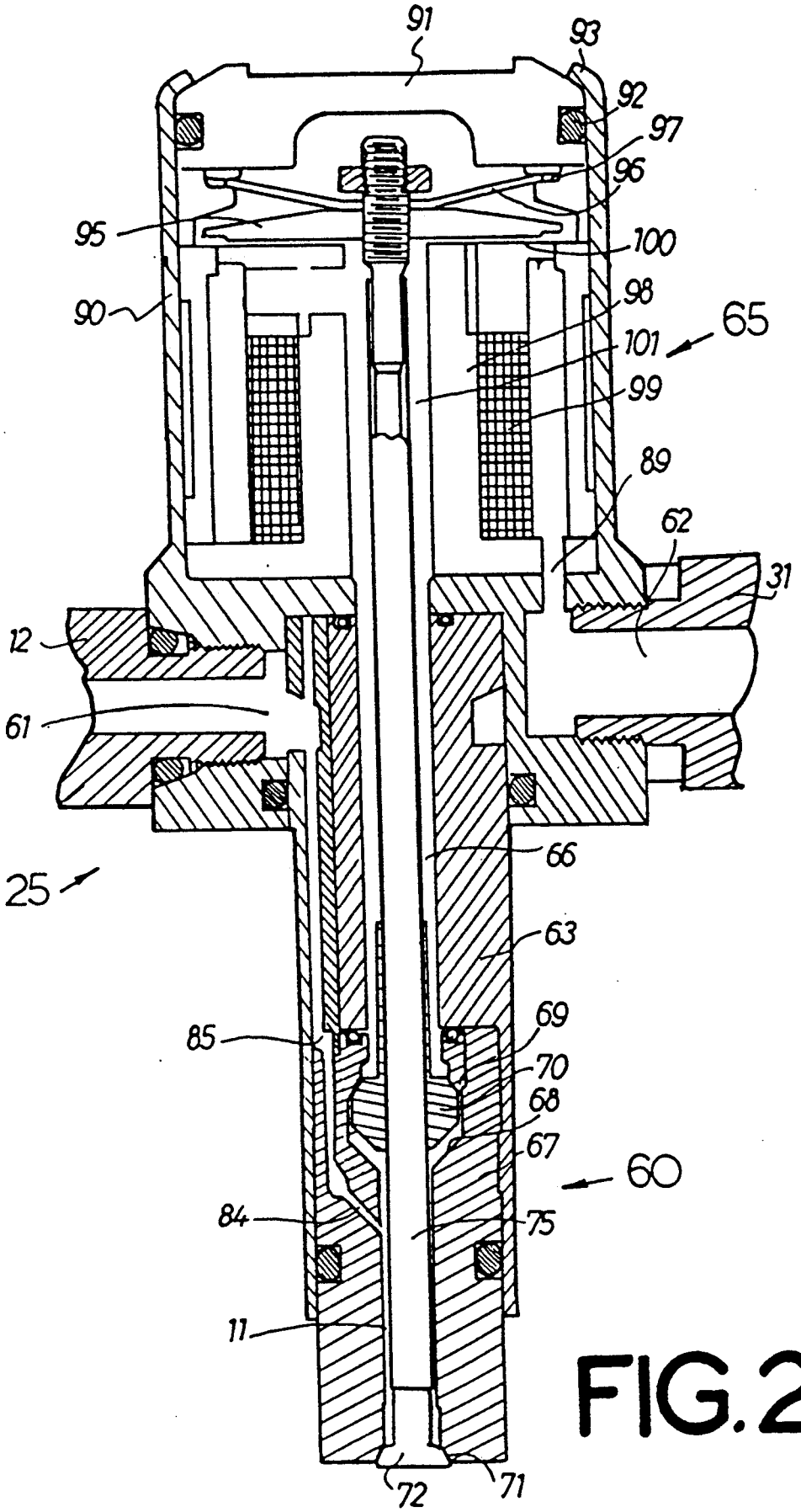
FIG. 2 is a sectional view of the metering unit.

Referring now to FIG. 2 of the drawings, the metering and injector unit 25 comprises a body 60 and a solenoid unit 65. The body 60 has a fuel inlet port 61 to which the fuel supply line 12 is connected and an air inlet port 62 to which the air supply line 31 is connected.

The body 60 has a stem portion 63 with a central bore 66 extending axially therethrough. The chamber body 67 is attached to the lower end of the stem portion 63, and has an axial chamber 68 therein. The axial chamber 68 communicates at the upper end with the central bore 66 of the stem portion 63 and includes the air port 69 with which the air valve 70 co-operates. At the lower end of the axial chamber is the delivery port 71 with which the delivery valve 72 co-operates. The portion of the axial chamber 68 between the air port 69 and the delivery port 71 constitutes the metering chamber 11.

Figure 3:
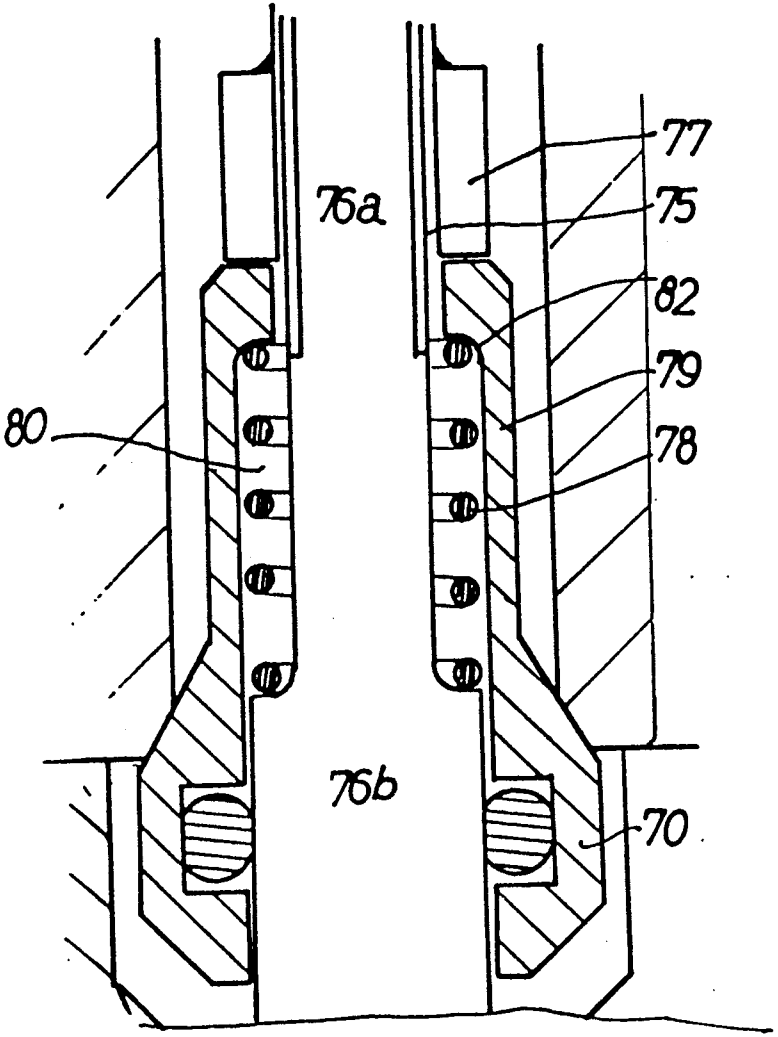
FIG. 3 is an enlarged sectional view of the gas valve and associate components of the metering unit shown in FIG. 2.

The delivery valve 72 is rigidly attached to the actuator rod 76 which extends from the solenoid unit 65 through the central bore 66 and axial chamber 68 including the metering chamber 11. The air valve 70 is non-rigidly attached to the actuator rod 75 as shown in more detail in FIG. 3. The actuator rod 76 is in two co-axial sections 76*a* and 76*b* screwed together at 75 in FIG. 3. The sleeve 77 is integral with the section 76*a* of the actuator rod and the air valve 70 is slidably supported on the section 76*b* of the actuator rod. The compression spring 78 is located in the annular cavity 80 between the section 76*b* and the extension 79 of the air valve 70, and engages the shoulder 81 on the actuator rod section 76*b* and the shoulder 82 on the extension 79. The compressed state of the spring 78 will normally hold the extension 79 of the air valve 70 against the sleeve 77. This construction will permit limited axial movement of the actuator rod 76 relative to the air valve 70. The O-ring seal 83 is located between the air valve 70 and actuator rod 76 to prevent fluid leakage therebetween when the air valve 70 is seated in the air port 69.

It will be appreciated that the above described construction provides that downward movement of the actuator rod 76 will displace the air valve 70 and the delivery valve 72 relative to their respective ports 69 and 71 to open each port for the passage of fluid therethrouqh. Upward movement of the actuator rod 76 will result in the closure of the port 69 and 71. Due to manufacturing tolerance, thermal condition, wear in service and other factors, it is not practical to attach both valves 70 and 72 rigidly to the actuator rod 76 and obtain substantially simultaneous opening and closing of the air and delivery ports 69 and 71. However, for optimum metering of the fuel such simultaneous operation is desirable. The above described sprung connection between the air valve 70 and the actuator rod 76 is a practical compromise wherein the air valve may close slightly before, and open slightly after the delivery valve, but will not in practical terms detract from the accuracy of the fuel metering.

It will be understood that the force developed in the spring 78 is sufficient that the air valve 70 will not open, due to any pressure differential existing across the valve in its normal closed state, independent of movement of the actuating rod.

The metering chamber 11 is in constant communication with the fuel inlet port 61 through the orifice 84 and passage 85. The orifice 84 is calibrated to provide known fuel flow rates for respective pressure differential across the orifice.

The solenoid unit 65 is housed within the cylindrical wall 90 forming part of the body 60 which is sealed at the upper end by the cap 91 and O-ring 92, held captive by the swaged margin 93 of the wall 90. The solenoid unit is thus within an enclosure through which air may pass from the air inlet port 62 via the opening 89 to provide air cooling of the solenoid unit.

The solenoid armature 95 is rigidly attached to the upper end of the actuator rod 76. The disc spring 96 is attached at the centre to the actuator rod 76, with the marginal edge of the disc captive in the annular groove 97. The disc spring 96 in its normal state is stressed to apply an upward directed force to the actuator rod 76 to hold the valves 70 and 72 in the closed position. The electric coil 99 is located about the core 98 and wound to produce a field when energized, to draw the armature 95 downward. The downward movement of the armature will effect a corresponding movement of the actuator rod 76 to open the air port 69 and delivery port 71. Upon de-energising of the coil 99, the spring 96 will raise the actuator rod 76 to close the ports 69 and 71. The degree of downward movement of the armature 95 is limited by the armature engaging the annular shoulder 100.

The core 98 of the solenoid unit has a central bore 101 which is in communication with the central bore 66. The air entering the air port 62 will thus flow through the solenoid unit to enter the bore 101 and hence pass to the bore 66 and through the air port 69 when the port is open. The flow of air through the solenoid unit provides cooling to assist in maintaining the temperature thereof within an acceptable level.

Figure 4:
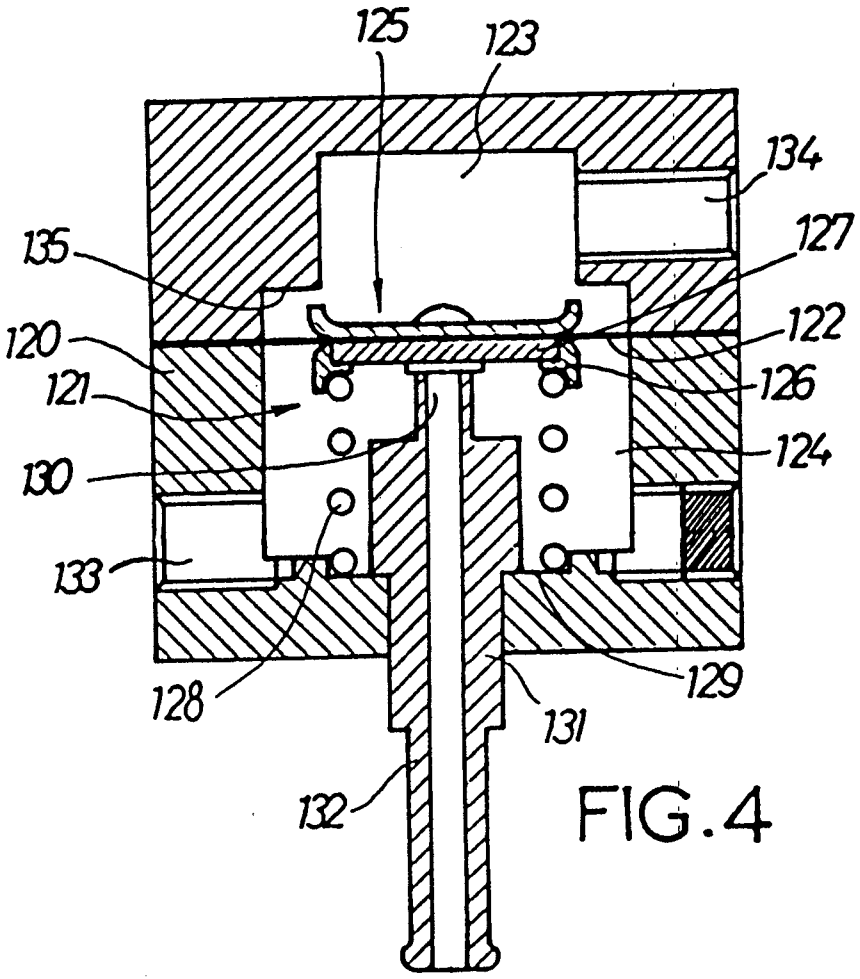
FIG. 4 is a sectional view of the fuel referencing regulator.

FIG. 4 illustrates a preferred construction of the fuel differing pressure regulator 16 as referred to in the preceding description of the fuel metering system with reference to FIG. 1.

The fuel differing pressure regulator comprises a body 150 supporting therein a voice coil type motor unit 151 including an annular permanent magnet 152 disposed concentrically about a central cylindrical armature 153. The annular coil 154 is located in the annular air gap 155 between the armature 153 and magnet 152.

The annular coil 154 is secured to the carrier member 156 upon which is mounted the value assembly 157. The inner peripheral portion of the disc spring 160 is clamped between the shoulder 149 on the carrier member 156 and spring retainer ring 158. The outer peripheral portion of the disc spring 160 is secured to the ring 159 and supported between the respective sealing O-rings 161 thereby providing a free annular portion 165 of the disc spring so that carrier member has a limited up and down movement by the deflection of the disc spring.

The valve assembly 157 comprises a valve element 170 suspended from the valve assembly housing 171 by the ball sector 172 seated in the cavity 173. The ball sector 172 is loaded by the spring 174 located about the spindle 175 to normally seat in the cavity 173. The attachment of the valve element 170 to the valve assembly housing 171 in this manner provides a degree of freedom of movement of the valve element 170 to properly seat on the end face of the fuel port 176 to effect closure of the latter.

The valve assembly housing 171 is threadably received at 177 in the carrier member 156 to permit initial adjustment of the valve element with respect to the port 176 so that the latter will effectively close the port when the carrier member is in a preselected position with a degree of deflection of the disc spring. The lock nut 78 is used to secure the valve assembly housing 171 in the set location.

The disc spring 180 is secured around its perimeter in the cavity 181 in the carrier member 156 and the adjustor rod 182 bearing on the upper side of the disc spring 180. The adjustor rod 182 extends through the armature 153 and threadably engages same at 183. Axial adjustment of the rod 182 in the housing controls the downward force the spring 180 applies to the carrier member 156 and hence to the valve element 170. The lock nut 184 secures the adjustor rod 182 in the selected position.

The adjustor rod 182 is made of an electrical insulating material, conductor rod 187 extending therethrough and connected to the disc spring 180 which is of a conductive material One terminal of the coil 154 is connected to the disc spring 180 and the other to the disc spring 160 which is connected to the conductor rod 185 located in the insulating sleeve 186. The carrier member is made of a suitable insulating material.

The external end of the passage 179 is adapted for the attachment of a suitable conduit so that fuel bypassed through the port 176 may be returned to the fuel reservoir 15 via the referencing regulator 34. The passage 190 is adapted to receive a conduit to communicate the port 176 with the pressurized fuel supply from the fuel pump 14 FIG. 1.

In use the pressure of the fuel supply from the fuel pump 14 acts on the under side of the valve element 170 to raise the valve element against the force applied by the voice coil motor 151. The motor 151 is arranged so that when the coil 154 is energized it will apply a downward force to the carrier member 156 opposing the force developed by the fuel pressure acting to raise the valve element 170. Accordingly the valve element 170 will be in a balanced state when the force generated by the motor 151 equals the force developed by the fuel pressure. It will thus be seen that the drop in fuel pressure through the port 176 may be regulated by the control of the current supply to the coil 154, and when this current supply is controlled in accordance with the fuel demand of the engine, the fuel pressure to the metering chamber 11 can be adjusted in accordance with the fuel demand of the engine.

Figure 5:
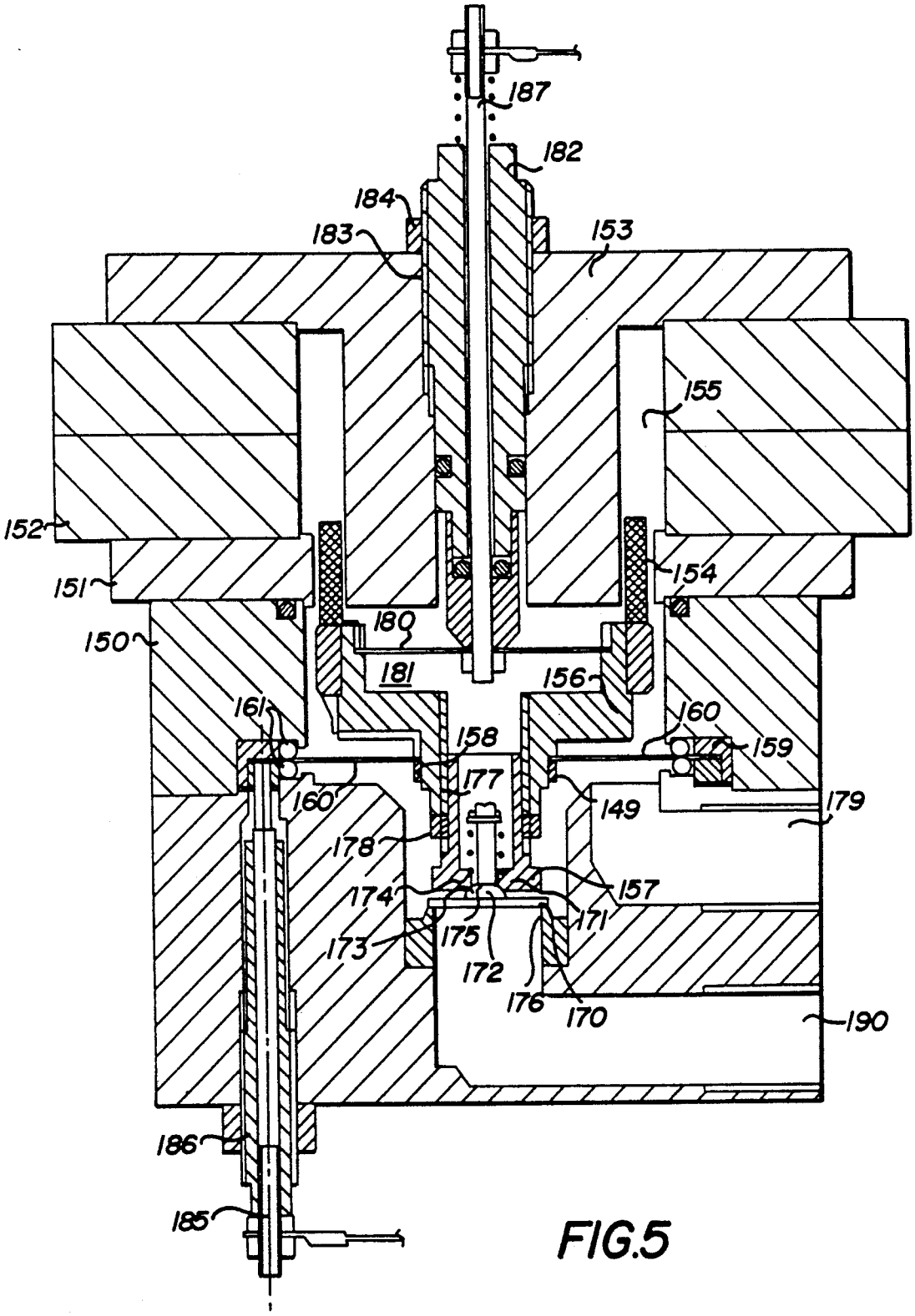
FIG. 5 is a sectional view of the gas-fuel regulator

Referring now to FIG. 5 which illustrates the fuel-air referencing regulator 34 as referred to in the previous description with reference to FIG. 1. The referencing regulator comprises a body 120 defining a cavity 121 which is divided by the diaphragm 122 into an air chamber 123 and a fuel chamber 124. The diaphragm 122 exhibits equal areas to the air chamber and fuel chamber.

The diaphragm 122 has a rigid central structure 125 providing a spring seat 126 and a valve element 127. The compression spring 128 is located between the seat 126 on the diaphragm and the seat 129 in the body 120 in a compressed state. The port tube 131 extends through the wall of the fuel chamber 124 and provides in the fuel chamber the port 30 with which the valve element 127 cooperates.

The external portion 132 of the port tube 131 is adapted to connect with a low pressure fuel line (36 FIG. 1) that will return fuel to the fuel reservoir 15. The port 133 is for connecting the lower pressure fuel bypass passage 179 of the fuel differing pressure regulator described with reference to FIG. 4. The port 134 is for connecting the air supply down stream of the air compressor 30 in FIG. 1.

The shoulder 135 is provided in the air chamber 123 to be engaged by the central structure 125 when the reference regulator is inoperative, to avoid damage to the diaphragm 122 by the force applied thereto by the spring 128.

In operation the total force applied to the diaphragm 122 on the air chamber side thereof is that arising from the pressure of the air supply, while the total force applied on the fuel chamber side is that arising from the pressure of the fuel plus the force created by the compressed state of the spring 128.

It will therefore be appreciated that the valve element 127 will move upwardly to open the port 130 when the air pressure is below the fuel pressure by an amount more than that represented by the force created by the spring. Accordingly, in operation a substantially constant pressure differential will exist between the air supply pressure and the pressure of the fuel on the downstream side of the valve element 170 of the fuel differing pressure regulator illustrated in FIG. 4.

It will be appreciated that the components described with reference to FIGS. 2, 3, 4 and 5 are incorporated into the fuel supply system described with reference to FIG. 1 of the drawings. It is to be understood that other systems of regulating the differential pressure between the air supply and the fuel supply may be employed in carrying the invention into effect.

I claim:

1. Apparatus for metering fuel to an engine, comprising:

a chamber having an open fuel port, a selectively openable gas port and a selectively openable delivery port;

regulating means for regulating a pressure differential between the fuel and gas supplies at the fuel and gas ports in response to engine load; and means for selectively opening said gas and delivery ports to deliver from the chamber when both said delivery and gas ports are open, the fuel in and fuel entering the chamber while the delivery port is open.

2. Apparatus for metering fuel to an engine, comprising:

a fixed capacity enclosed chamber having a fuel delivery port and a gas admission port;

valve means for selectively opening and closing said ports substantially simultaneously;

fuel supply means for providing a continuous supply of fuel for admission to said chamber under pressure;

gas supply means for providing gas for admission to the chamber when both said parts are open to establish in the chamber a pressure not greater than the fuel pressure; and means for regulating the pressure difference between the gas in the chamber when the ports are open and the fuel supply to thereby regulate the quantity of fuel delivered while the delivery port is open.

3. Apparatus for metering fuel as claimed in claim 1 wherein said regulating means includes means for regulating fuel supply pressure with respect to gas supply pressure, and means for regulating the pressure differential in response to the engine load.

4. Apparatus for metering fuel as claimed in claim 1 wherein said regulating means includes first means for regulating fuel supply pressure with respect to a reference pressure, and second means for regulating the reference pressure with respect to air supply pressure.

5. Apparatus as claimed in claim 4 wherein the first means comprises an orifice means for bleeding fuel from the fuel supply upstream of the fuel port, control means for varying a pressure drop through said orifice means in response to the engine load, and wherein said second means regulates pressure of the bled fuel downstream of the orifice means.

6. Apparatus as claimed in any one of claims 1 or 2 including means for controlling the duration of the opening of the delivery port.

7. Apparatus as claimed in claim 2 wherein the delivery and gas port valve means are each coupled to a solenoid, adapted to open the ports when energized, and wherein the control means varies the period of energization of the solenoids.

8. Apparatus as claimed in claim 1 wherein the chamber is an enclosed fixed capacity chamber.

9. Apparatus as claimed in claim 1 wherein the gas and delivery ports are arranged to open and close substantially simultaneously.

10. Apparatus as claimed in claim 9 wherein the gas and delivery ports each have valve means for selective opening and closing of the ports, said valve means being coupled to a solenoid adapted to open the ports when energized, and control means for varying the period of duration of energization of the solenoid.

11. Apparatus as claimed in any one of claims 2 or 7 wherein the delivery and gas ports are arranged coaxially, and wherein valve means are associated with each said port, said valve means being coupled together for opening and closing said delivery and gas ports substantially simultaneously.

12. Apparatus as claimed in claim 10 wherein one valve means is rigidly coupled to an actuator member and the other valve means is coupled to said actuator member for limited movement relative thereto, whereby movement of the actuator member in one direction effects closure of the ports by the respective valve means, the arrangement being such that after said other valve means has closed the associated port, the actuator member may move relative to said other valve means to close the port associated with the one valve means.

13. Apparatus as claimed in claim 12 wherein the movement of the other valve means relative to the actuator is resisted by resiliently deflectable means.

14. Apparatus as claimed in any one of claims 1 or 2 wherein the fuel supply includes pump means for delivering fuel from a fuel reservoir to the chamber, and the regulating means means for bypassing fuel upstream of the pump means to the fuel reservoir, and means for regulating the fuel flow rate through the bypass to control the fuel pressure at the chamber.

15. Apparatus as claimed in claim 13 wherein the means for regulating the flow rate through the bypass is operable in response to the engine fuel demand.

16. Apparatus as claimed in claim 14 wherein the means for regulating the flow rate through the bypass is a variable size orifice.

17. Apparatus as claimed in claim 14 wherein the regulating means also includes means for controlling the pressure against which the fuel is bypassed.

18. Apparatus as claimed in claim 17 wherein said means for controlling the pressure is adapted to maintain a predetermined differential between said pressure and the pressure of the gas supply.

* * * * *